US007402043B2

(12) United States Patent
Komiyama et al.

(10) Patent No.: US 7,402,043 B2
(45) Date of Patent: Jul. 22, 2008

(54) CONNECTOR HOLDER STRUCTURE

(75) Inventors: Ryuichi Komiyama, Machida (JP); Yoshinori Hitomi, Toyota (JP); Katsutoshi Fukunaga, Chiryu (JP); Makoto Suzumura, Chita (JP); Yukinobu Kunimatsu, Toyoake (JP)

(73) Assignee: Tyco Electronics AMP K.K., Kanagawa-Ken (JP)

( * ) Notice: Subject to any disclaimer, the term of this patent is extended or adjusted under 35 U.S.C. 154(b) by 865 days.

(21) Appl. No.: 10/938,810

(22) Filed: Sep. 10, 2004

(65) Prior Publication Data

US 2005/0050842 A1 Mar. 10, 2005

(30) Foreign Application Priority Data

Sep. 10, 2003 (JP) ..... 2003-318734

(51) Int. Cl.
*H01R 33/00* (2006.01)

(52) U.S. Cl. ..... 439/34; 439/534

(58) Field of Classification Search ..... 439/34, 439/534; 307/10; 174/72 A
See application file for complete search history.

(56) References Cited

U.S. PATENT DOCUMENTS 5,667,398 A 9/1997 Kidd et al.
5,975,933 A * 11/1999 Yamaguchi et al. ..... 439/247
6,602,077 B2 * 8/2003 Kasper et al. ..... 439/34
7,044,744 B2 * 5/2006 Sellien ..... 439/34
2002/0177331 A1 * 11/2002 Kasper et al. ..... 439/34
2005/0059267 A1 * 3/2005 Sellien ..... 439/34
2005/0136697 A1 * 6/2005 Fukunaga et al. ..... 439/34

FOREIGN PATENT DOCUMENTS

EP 1031683 A1 8/2000
EP 1108835 A2 6/2001
EP 1255004 A3 2/2004

* cited by examiner

*Primary Examiner*—Gary F. Paumen
(74) *Attorney, Agent, or Firm*—Barley Snyder LLC

(57) ABSTRACT

The present invention relates to a connector holding structure in which a connector is held in a door frame, the connector being mated with a mating connector attached to a fulcrum end of a door handle and pivotally held in the door frame. The connector holding structure according to the present invention allows the connector to be smoothly mated with the mating connector while permitting a change in the orientation of the connector caused by a pivoting motion of the door handle. The connector has two projections arranged on each side in a horizontal direction. A door frame has a guide groove extending along a horizontal direction in association with a direction in which the two projections are arranged, and two grooves extending downward from the guide groove in association with the two projections to permit pivoting motion of the connector.

6 Claims, 4 Drawing Sheets

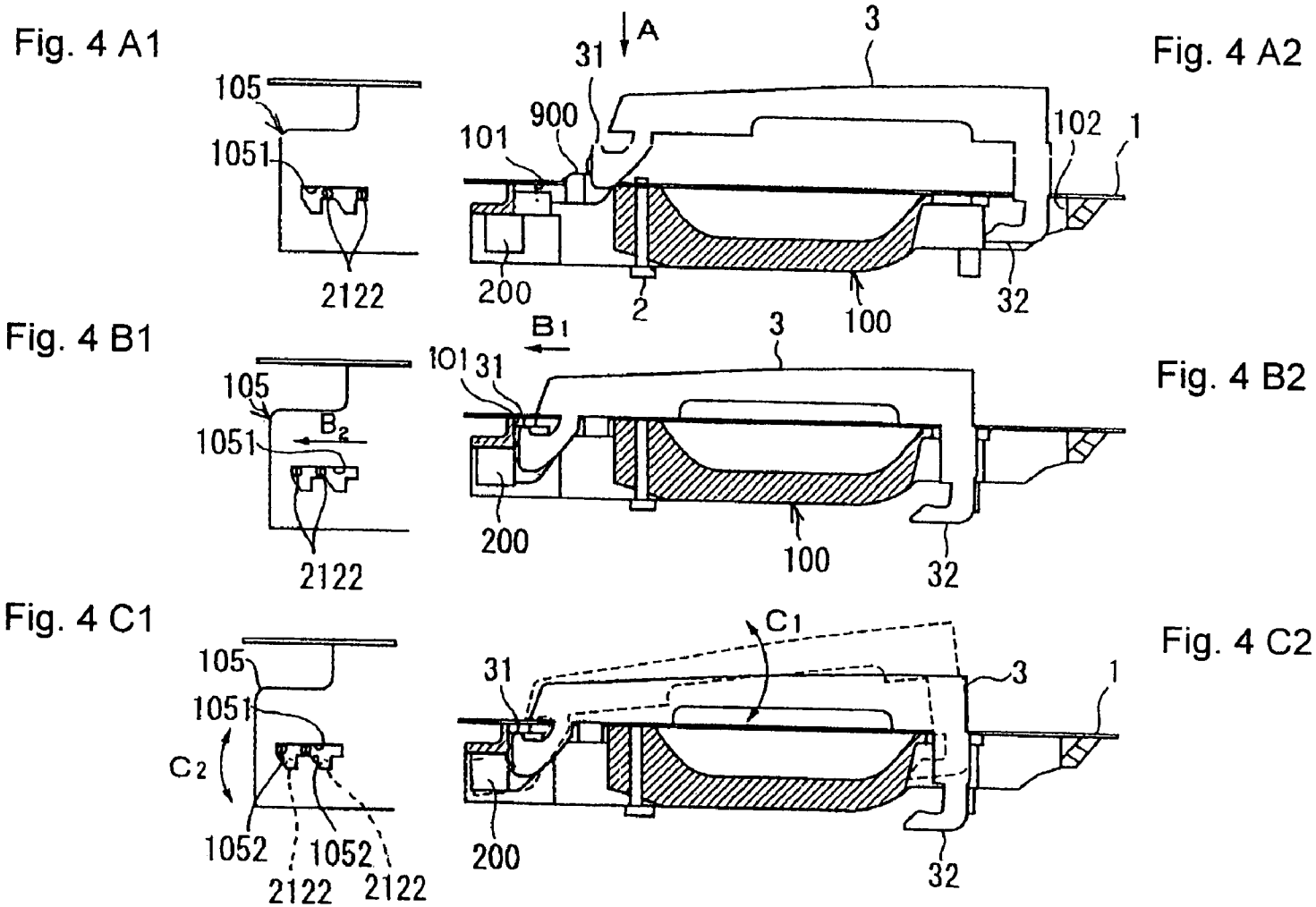
Fig. 4 A2
Fig. 4 B2
Fig. 4 C2
Fig. 4 A1
Fig. 4 B1
Fig. 4 C1
1
102
32
3
100
A
31
900
101
2
200
B1
C1
105
1051
2122
B2
1052
C2

CONNECTOR HOLDER STRUCTURE

FIELD OF THE INVENTION

The present invention relates to a connector holding structure for holding a connector in a door frame, the connector being fitted into a mating connector attached to an end of a door handle pivotally connected to the door frame.

BACKGROUND

Keyless entry systems have become more widely used in automobiles and the like to unlock a locked door. A predetermined signal is transmitted and detected to unlock the door instead of inserting a key into a keyhole for unlocking the door. Some of the automobiles employing the keyless system have a sensor built into a door handle to detect the predetermined signal.

European Patent Application Publication No. 1031683 discloses a set of fitted connectors that interconnect a cable from the sensor detecting the predetermined signal and a cable from a control section provided inside the door. The sensor detecting the predetermined signal is built into the door handle. The set of connectors are located inside a door panel. The door handle described in European Patent Application Publication No. 1031683 is pivoted using one end as a fulcrum. The end acting as a fulcrum is inserted into the door panel. A connector to which a cable from the sensor is connected is attached to this end. On the other hand, a connector fitted into the above connector and to which the cable from the control section is connected is held by a spring member in the door frame. When the door handle is pivoted with the connector of the control section fitted into the connector of the door handle, the orientation of the set of fitted connectors changes. A structure holding the connector of the control section in the door frame as described in European Patent Application Publication No. 1031683 uses the spring member to hold the connector of the control section so as to permit a change in the orientation of the connector caused by pivoting the door handle.

To fit the connector of the control section and the connector of the door handle into each other, the connector of the door handle is brought proximate the connector of the control section for mating. That is, the connector of the control section acts as a receiving connector. To smoothly fit both connectors into each other, it is necessary to accurately position the connector of the control section so that the connector of the control section assumes the correct orientation in which its fitted surface faces the approaching connector of the door handle.

Other connectors are disclosed in European Patent Application Publication No. 1108835 and in European Patent Application Publication No. 1255004.

However, as the structure holding the connector of the control section in the door frame as described in European Patent Application Publication No. 1031683 uses the spring member to hold the connector, it is difficult to accurately position the connector of the control section in the door frame so that the connector can assume the correct orientation. An operation of mating this connector into the mating connector cannot be preformed smoothly. Further, even though the connector is accurately positioned in the door frame so that the connector can assume the correct orientation, the orientation or position of the connector may deviate during the mating operation. This also hinders the mating operation from being smoothly performed.

SUMMARY

According to an exemplary embodiment of the present a connector holding structure is provided that allows a connector to be smoothly mated with a mating connector attached to a pivoting structure while permitting a change in the orientation of the connector caused by a pivoting motion of the pivoting structure. The connector holding structure holds a connector in a door frame, the connector being fitted into a mating connector pivotally attached to a fulcrum end of a door handle and pivotally held in the door frame, wherein the connector has two projections arranged on each side in a horizontal direction, and the door frame has a guide groove extending along a horizontal direction in association with a direction in which the two projections are arranged, and two grooves extending downward from the guide groove in association with the two projections so as to permit pivoting motion of the connector.

BRIEF DESCRIPTION OF THE DRAWINGS

FIGS. 4*a*1-4*c*2 show, step by step, an operation of mating a mating male connector attached to the door handle, into the female connector, shown in FIG. 3 and held by the door frame, shown in FIG. 1, and also showing how the door handle is pivoted.

DETAILED DESCRIPTION OF THE EMBODIMENT(S)

Figure 1:
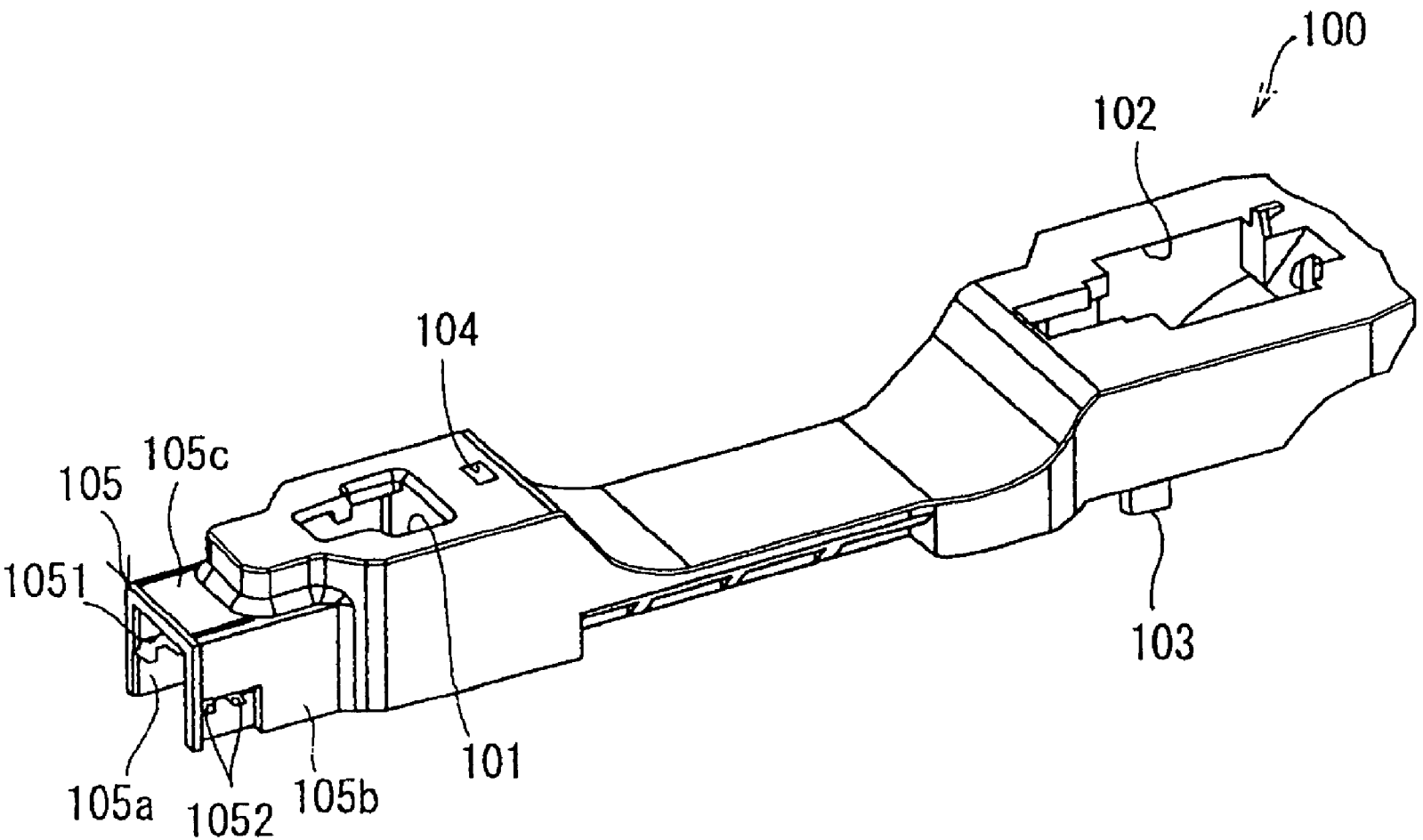
FIG. 1 is a perspective view of a door frame installed inside a door panel of an automobile.

In an exemplary embodiment of the invention, a connector holding structure holds a female connector in a door frame inside a door panel of an automobile. A door frame 100 shown in FIG. 1 is mounted inside a door panel 1 not shown in FIG. 1 (see FIG. 4*a*2). A door handle 3 also not shown in FIG. 1 (see FIG. 4*a*2) is incorporated into the door frame 100, mounted inside the door panel. A sensor (not shown) that detects a predetermined signal is built into the door handle, incorporated into the door frame. The automobile to which the door handle is attached is provided with a control section that unlocks the door when the sensor detects the predetermined signal. The predetermined signal is continuously transmitted by a key which is carried by a user of the automobile and which is used to start the engine. Thus, when the person carrying the key for starting the engine approaches the automobile to which the door handle 3 is attached, the door is automatically unlocked. A male connector 900 (see FIG. 4*a*2) is attached to a pivoting end of the door handle 3. Wiring extends from the sensor, built into the door handle 3, and its leading end is introduced into the male connector 900.

Insertion slots 101 and 102 are formed at respective ends of the door frame 100, shown in FIG. 1. The pivoting or fulcrum end of the door handle is inserted into the smaller insertion slot 101, located in the left of FIG. 1. The end of the door handle 3 which is opposite the fulcrum end is inserted into the larger insertion slot 102, located in the right of FIG. 1. Further, paired backlash preventing projections 103 spaced from each other in a width direction of the door frame 100 project from a bottom surface of the end of the door frame 100 at which the larger insertion hole 102 is formed. The end of the door handle inserted into the larger insertion slot 102 slips in between the paired backlash preventing projections 103 to prevent the door handle from shaking in the width direction of the door frame 100. A threaded slot 104 is formed near the smaller insertion hole 101 in the door frame 100. The door frame 100 is attached to the door panel using a screw 2 (see FIG. 4) screwed into the threaded slot 104. Moreover, a holding section 105 holding a female connector 200 not shown here (see FIG. 3) is provided at the end of the door frame 100 at which the smaller insertion slot 101 is formed. The holding section 105, shown in FIG. 1, is U-shaped and opens downward. The holding section 105 has opposite side walls 105*a* and 105*b* and a top wall 105*c* joining upper edges of the side walls 105*a* and 105*b* to each other. An internal space in the holding section 105 is in communication with the smaller insertion hole 101. Each of the opposite side walls 105*a* and 105*b* is formed with a guide groove 1051 and two pivoting grooves 1052 merged with the guide groove 1051.

Figure 2:
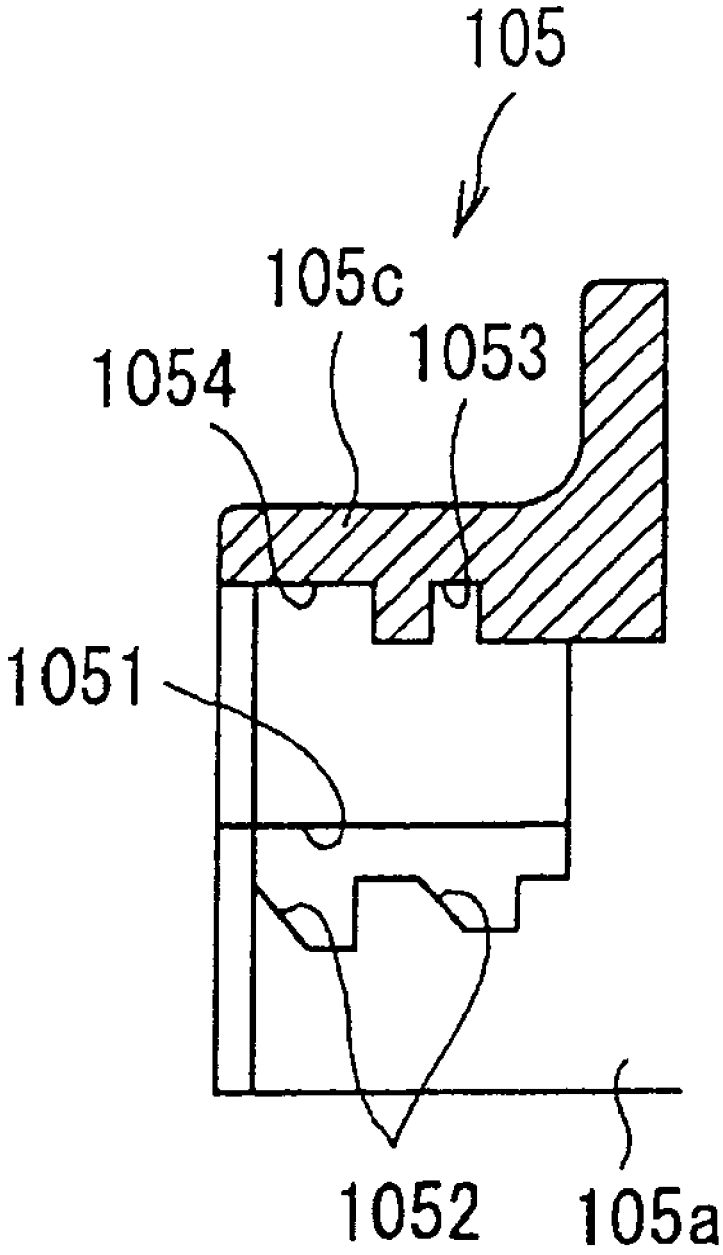
FIG. 2 is a sectional view of a holding section provided on the door frame, shown in FIG. 1, the view being taken along a longitudinal direction of the door frame.

As shown in FIG. 2, the guide groove 1051 formed in the holding section 105 is a through-groove extending horizontally in the longitudinal direction of the door frame 100. The two pivot grooves 1052 are through-grooves spaced from each other at a predetermined distance and extending downward from the guide groove 1051.

Further, as shown in FIG. 2, two notches 1053 and 1054 are formed in an inner surface of the top wall 105*c* of the holding section 105. The two notches 1053 and 1054, as shown in FIG. 2, are spaced from each other in the direction in which the guide groove 1051 extends.

Figure 3:
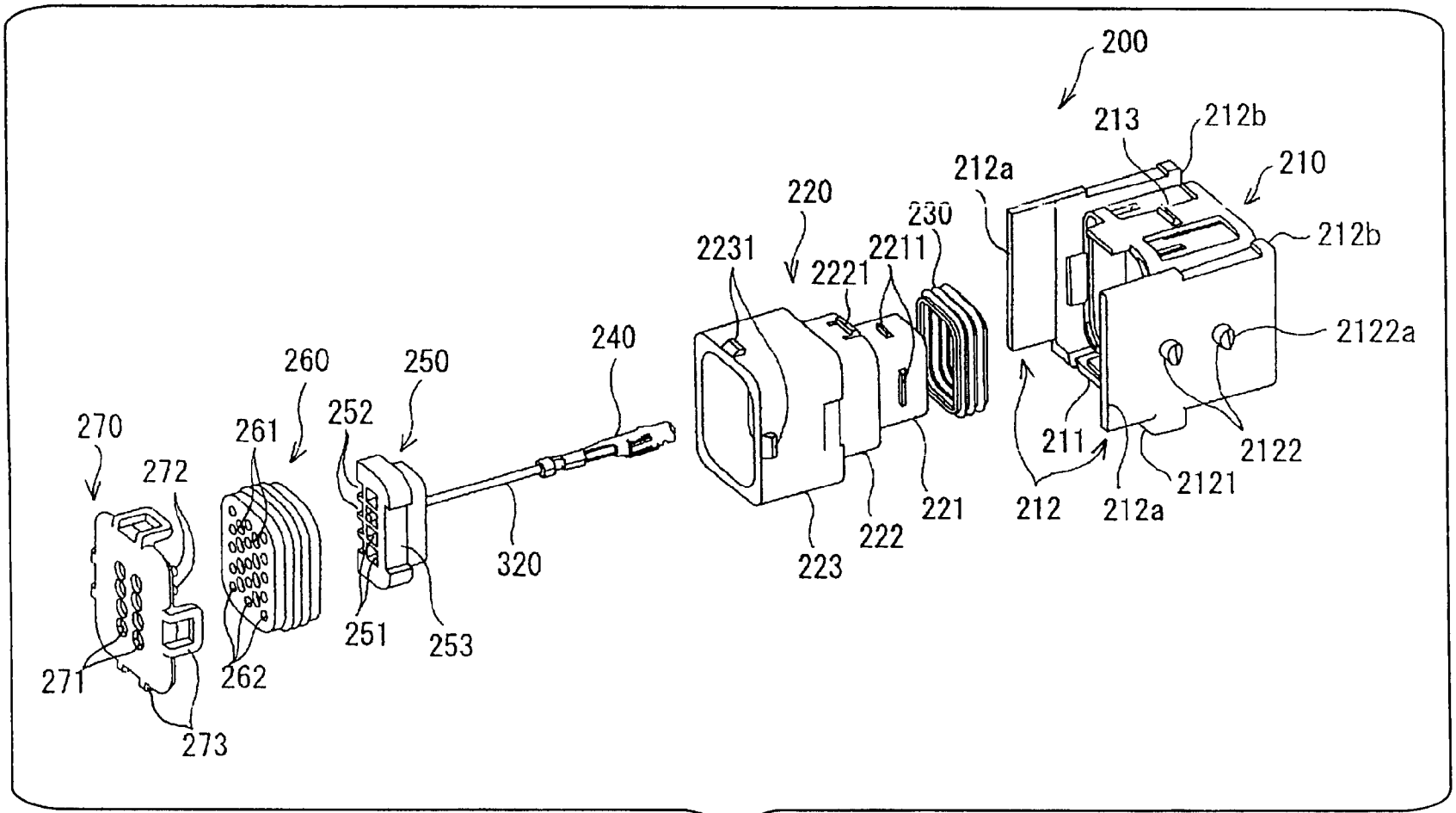
FIG. 3 is an exploded perspective view of a female connector held by the holding section of the door frame, shown in FIG. 1.

FIG. 3 is an exploded perspective view of the female connector 200, held by the holding section 105 of the door frame 100. The wiring extending from the control section, which unlocks the door, comprises conductors 320 that are introduced into the female connector 200, shown in FIG. 3. The female connector 200 has an outer housing 210, an inner housing 220, a seal ring 230, a female contact 240, a secondary locking member 250, a batch rubber stopper 260, and a cover member 270.

The outer housing 210 is composed of a flexible plastic material. The outer housing 210 is provided with a lock arm 211, paired unlocking sections 212, and a locking projection 213. When the female connector 200 is fitted around the male connector 900 attached to the door handle 3, the lock arm 211 engages with the male connector 900, which is the mating connector in this exemplary embodiment.

The paired unlocking sections 212 are provided on the respective sides of the outer housing 210, and project from respective sides of a fitted surface of the female connector 200 in a direction opposite to the mating direction. When leading ends 212*a* of the paired unlocking sections 212 in a projecting direction are pushed toward each other from the outside, the paired unlocking sections 212 are deflected using trailing ends in the projecting direction (the right-hand ends in FIG. 3) 212*b* as a pivot shaft. Each of the paired unlocking sections 212 is provided with a folded piece 2121 folded toward the lock arm 211. A leading end surface of the folded piece 2121 is located near sides of the lock arm 211. When the leading ends 212*a* of the paired unlocking sections 212 in the projecting direction are pushed toward each other from the outside, the leading end surface of the folded piece 2121 cam-engages with the sides of the lock arm 211 to make the lock arm 211 movable. Further, each of the paired unlocking sections 212 has two projections 2122 arranged in parallel in a horizontal direction. The projections 2122 are inserted into the guide groove 1051 in the door frame 100, shown in FIG. 1. Leading ends 2122*a* of the projections 2122 are chamfered so as to be easily inserted into the door frame 100. The door frame 100 holds the female connector 200, shown in FIG. 3, at a predetermined receiving position at which the female connector 200 is to receive the mating male connector 900. In this case, the locking projecting section 213 slips into one of the two notches 1053 and 1054, shown in FIG. 2, that is, the notch 1053, which is closer to the insertion slot 102, shown in FIG. 1. The locking projecting section 213 fitted in the notch 1053 prevents the female connector 200 from being easily moved or having its orientation easily changed. Therefore, according to the connector holding structure of the present embodiment, when the female connector 200 is fitted around the mating male connector 900, the female connector 200 receives the mating male connector 900 at the predetermined receiving position while maintaining the correct orientation. This enables both connectors to be mated.

To unmate the female connector 200, shown in FIG. 3, and the mating male connector 900, the connectors may be separated from each other so that the leading ends 212*a* of the paired unlocking sections 212 in the projecting direction, provided on the female connector 200, are pushed toward each other from the outside. Further, the projections 2122 inserted into the guide groove 1051 in the door frame 100 slip out of the guide groove 1051 by the operation performed at this time to push the paired unlocking sections 212 from the outside. Then, the female connector 200 can be removed from the door frame 100.

One conductor 320 is connected to the one female contact 240, shown in FIG. 3. FIG. 3 shows only one female contact 240 but the wiring introduced into the female connector 200, shown in FIG. 3, is composed of eight conductors. Actually, eight female contacts 240 are installed.

An inner housing 220 shown in FIG. 3 is composed of a plastic material to which a glass material is added. The inner housing 220 is thus inflexible and has a high dimensional precision. The inner housing 220 is provided with three main body sections: a large 223, intermediate-sized 222, and small 221 body sections. The eight female contacts 240 are housed in the inner housing 220 so that their leading ends are located inside the small body section 221. An outer peripheral surface of the small body section 221 is provided with multiple locking projections 2211 locking the seal ring 230. Further, the inner housing 220 is inserted into the outer housing 210. An outer peripheral surface of the intermediate-sized body section 222 of the inner housing 220 is provided with a locking projection 2221 that is locked in the outer housing 210. Moreover, an outer peripheral surface of the large body section 223 of the inner housing 220 is provided with multiple locking projections 2231 over which the cover member 270 is locked.

The secondary locking member 250 holds the eight female contacts 240. The secondary locking member 250 has four closed cavities 251 arranged in a one vertical line in FIG. 3 and four open cavities 252 arranged in a one vertical line in FIG. 3. Rear halves (left-hand halves in FIG. 3) of the eight female contacts 240 are housed in the cavities 251 and 252. The secondary locking member 250 is provided with a concave portion 253 into which a jig is inserted during assembly.

The batch rubber stopper 260 is provided at a port into which the female connector 200 is introduced. Accordingly, after the female connector 200 has been held in the door frame 100 shown in FIG. 1, even if external water runs along the door frame 100 or the like and reaches the wiring introduction port of the female connector 200, the batch rubber stopper 260 hinders the water from infiltrating into the female contact 200. This reliably makes the connector waterproof. The batch rubber stopper 260 is a plate-like rubber member having a total of eight through-holes 261 arranged in two vertical lines, each including four of them, as shown in FIG. 3. The eight conductors 320 are inserted through the eight, respective through-holes 261. Besides the through-holes 261, the batch rubber stopper 260 has a total of 15 concave sections 262 arranged in three vertical lines each including five of them, as shown in FIG. 3.

The cover member 270 is also formed with eight through-holes 271 corresponding to the eight through-holes 261, formed in the batch rubber stopper 260. The eight conductors 320 are inserted through the respective through-holes 271. The cover member 270 is also provided with 15 convex sections 272 corresponding to the 15 concave sections 262, formed in the batch rubber stopper 260. The cover member 270 is further provided with locking levers 273 into which the respective locking projections 2231, provided on the large body section 223 of the inner housing 200, are slipped.

Now, description will be given of a process of assembling the female connector 200, shown in FIG. 3. First, the leading ends of the eight conductors 320 are passed through the eight, respective through-holes 271 in the cover member 270 and then through the eight, respective through-holes 261 in the batch rubber stopper 260. Then, a connecting operation is performed. In the connecting operation, the leading ends of the eight conductors 320 are crimped to the eight, respective female contacts 240. In addition to the connecting operations, the following two operations are performed: the operation of mating the secondary locking member 250 into the inner housing 220 and the operation of covering the small body section 221 of the inner housing 220 with the seal ring 230 and then using the multiple locking projections 2211, provided on the small body section 221, to lock the seal ring 230. Then, the female contacts 240 to which the conductors 320 are connected are inserted through the secondary locking member 250 in the inner housing 220. Each of the female contacts 240 is provided with a lance (not shown). When the female contact 240 is inserted until the leading end of the female contact 240 is positioned inside the small body section 221 of the inner housing 220, the lances are locked in the inner housing 220 to set the position of each female contact 240 in the inner housing 220. Then, a jig is inserted into the concave portion 253, formed in the secondary locking member 250 in the inner housing 220, to slide the secondary locking member 250 in a direction away from the reader in FIG. 3. Thus, each female contact 240 is locked and held in the secondary locking member 250. Subsequently, the batch rubber stopper 260 is fitted into the large body section 223 of the inner housing 220. Moreover, the cover member 270 is attached to the inner housing 220. In attaching the cover member 270, the multiple locking levers 273 of the cover member 270 are locked over the respective locking projections 2231, provided on the large body section 223 of the inner housing 220. Finally, the inner housing 220 is mounted in the outer housing 210. In mounting the inner housing 220, the locking projection 2221, provided on the intermediate-sized body section 222 of the inner housing 220, are locked in the outer housing 210. When the assembled female connector 200 and the mating male connector 900 are fitted together, the seal ring 230, provided in the female connector 200, reliably makes the fitted surfaces of both connectors waterproof.

Next, with reference to FIGS. 4*a*1-4*c*2, description will be given of an operation of mating the female connector 200, shown in FIG. 3, and the mating male connector 900 into each other.

As shown in FIG. 4*a*2, the end 32 (on the right side in FIG. 4*a*2) of the door handle 3, which is opposite the fulcrum, is inserted through the larger insertion slot 102 in the door frame 100, shown in FIG. 1, before the insertion is completed. The door frame 100, shown in FIG. 4*a*2 is mounted inside the door panel 1 using the screw 2. The female connector 200, shown in FIG. 3, is held in the holding section 105 of the door frame 100. In this case, the female connector 200 has, at a predetermined receiving position, its fitted surface held so as to face the insertion slot 101 in the door frame 100. As shown in FIG. 4*a*1, the projections 2122, provided on the female connector 200, are located in the guide groove 1051 in the holding section 105 and at the insertion slot 101. Further, the locking projection 213 of the female connector 200, shown in FIG. 3, has slipped into one of the two notches 1053 and 1054, shown in FIG. 2, that is, the notch 1053, which is closer to the insertion slot 102, shown in FIG. 1. Thus, the female connector 200 is set to receive the mating male connector 900 at a predetermined receiving position while maintaining the correct orientation.

A fulcrum end 31 of a door handle 3, to which a mating male connector 900 is attached, is inserted in the direction of an arrow A in FIG. 4*a*2 through the insertion slot 101. This insertion causes an end 32 of the door handle 30 which is opposite the fulcrum to be inserted deeper through the insertion slot 102.

FIG. 4*b*2 shows that the door handle has been slid (to the left in FIG. 4*b*2) to fit the female connector 200, shown in FIG. 3, and the mating male connector 900 into each other. The door handle 3 shown in FIG. 4*b*2 shows that both ends 31 and 32 of the door handle 3 have been inserted deep into the door frame 100. In this state, when the door handle 3 is slid in the direction of an arrow B1, the mating male connector 900, attached to the door handle 3, is pushed into the female connector 200 held at the predetermined receiving position. The connectors are thus mated. In this case, the male connector 900 pushes and moves the female connector 200 held at the predetermined receiving position, backward to a predetermined mating completion position. Then, as shown in FIG. 4*b*1, the projections 2122, provided on the female connector 200, moves, inside the guide groove 1051 in the holding section 105, to the position farthest from the insertion slot 101 (see an arrow $B_2$). Further, the locking projection 213 of the female connector 200, shown in FIG. 3, slips into one of the two notches 1053 and 1054, shown in FIG. 2, the notch 1054, located farther from the insertion slot 102, shown in FIG. 1.

The female connector 200 and the mating male connector 900 in a mated state as described above have their orientation integrally changed as the door handle 3 is pivoted FIG. 4*c*2 shows the pivoting motion of the door handle 3. The door handle 3 is pivoted using its end 31, to which the male connector 900 is attached, as a fulcrum. In this figure, a dotted line shows how the door handle 3 shown in FIG. 4*b*2 is pivoted. When the door handle 3 is pivoted as shown by arrow $C_1$, the end 32 of the door handle 3, which is opposite the fulcrum, is raised from the door frame 100. This causes the door handle 3 to tilt with respect to the door panel 1. In this case, as shown in FIG. 4*c*1, in the connector holding structure according to the present embodiment, the projections 2122, provided on the female connector 200, can escape from the guide groove 1051 into the pivot groove 1052 in the holding section 105. This permits the female connector 200 to tilt similarly to the mating male connector 900 (see arrow $C_2$).

While the connector holding structure according to the present invention is illustrated and described with reference to a structure holding a female connector in a door frame attached to a door panel of an automobile, it should not be interpreted as being limited thereto, but rather should be understood to include alternative embodiments. For example, the present invention is also applicable to structures holding a male or female connector in door frames attached to various members.

What we claim is:

1. A connector holding structure for holding a connector in a door frame, the connector being mated with a mating connector pivotally attached to a fulcrum end of a door handle and pivotally held in the door frame, wherein the connector has two projections arranged on each side in a horizontal direction, and the door frame has a guide groove extending along a horizontal direction in association with a direction in which the two projections are arranged, and two grooves extending downward from the guide groove in association with the two projections to permit pivoting motion of the connector.

2. The connector holding structure according to claim 1, wherein the door frame comprises an insertion hole for receiving the fulcrum end of the door handle and a holding section that has opposite side walls and a top wall joining upper edges of the side walls to each other, the side walls and top wall defining an internal space in communication with the insertion hole, the side walls each having a guide groove formed therein and two pivoting grooves communicating with each guide groove.

3. The connector holding structure according to claim 1, wherein the connector is provided with a pivotal lock arm that engages the mating connector, paired pivotal unlocking sections that pivot the locking arm when pushed toward each other, the lock arm and the unlocking sections being exposed when the connector is mated to the mating connector.

4. The connector holding structure according to claim 3, wherein the connector and the mating connector may be separated from each other by pushing the unlocking sections toward each other from the outside.

5. The connector holding structure according to claim 4, wherein the guide grooves are spaced apart such that the projections are withdrawn from the guide groove when the unlocking sections are pushed together.

6. The connector holding structure according to claim 1, wherein the connector holding structure holds a female connector in a door frame inside a door panel of an automobile.

* * * * *